US006021735A

United States Patent [19]

Kamen

[11] Patent Number: 6,021,735

[45] Date of Patent: Feb. 8, 2000

[54] BOOK MARK FOR DUAL COLUMN PAGE

[76] Inventor: Jack M. Kamen, 8782 N. Cricket Tree La., Indianapolis, Ind. 46260

[21] Appl. No.: 09/136,536

[22] Filed: Aug. 19, 1998

Related U.S. Application Data

[63] Continuation-in-part of application No. 08/742,884, Nov. 1, 1996, Pat. No. 5,803,012.

[51] Int. Cl.[7] ..... B42D 9/00

[52] U.S. Cl. ..... 116/234; 116/235; 116/240

[58] Field of Search ..... 116/235, 240, 116/234, 236, 237, 238, 239

[56] References Cited

U.S. PATENT DOCUMENTS

| | | | |
|---|---|---|---|
| D. 32,731 | 5/1900 | Conger . | |
| D. 333,317 | 2/1993 | Jimenez | D19/32 |
| 446,857 | 2/1891 | Fiske | 116/235 |
| 1,420,265 | 6/1922 | Kieckhefer | 116/235 |
| 1,966,340 | 7/1934 | Forbringer et al. | 116/235 |
| 2,475,698 | 7/1949 | Croker | 116/235 X |
| 2,543,182 | 2/1951 | Lang . | |
| 2,953,115 | 9/1960 | Haskins | 116/255 |
| 3,266,456 | 8/1966 | O'Reilly | 281/42 X |
| 4,358,012 | 11/1982 | Marsala et al. | 281/42 X |
| 4,901,665 | 2/1990 | Carlin | 116/235 |
| 5,081,948 | 1/1992 | Walsh | 116/235 |
| 5,311,835 | 5/1994 | Knowles | 116/235 |
| 5,325,811 | 7/1994 | Miroyan | 116/235 |
| 5,515,809 | 5/1996 | Weinberg | 116/235 |
| 5,803,012 | 9/1998 | Kamen | 116/235 |

*Primary Examiner*—Hezron Williams
*Assistant Examiner*—Willie Morris Worth
*Attorney, Agent, or Firm*—Barnes & Thornburg

[57] ABSTRACT

A book mark is provided for marking a selected line, column, and page of a book. The book mark includes a flat elongated member, first and second page indicators, a line marker, and a column indicator. The flat elongated member has a first end, a second end spaced apart from the first end, and a middle region situated between the first and second ends. Each of the first and second page indicators includes an indicia positioned on the flat elongated member. The line marker marks the selected line, is fixed relative to and spaced apart from the first and second page indicators, and is situated in the middle region of the flat elongated member. The column indicator indicates a specific column in a book having dual column pages.

70 Claims, 4 Drawing Sheets

BOOK MARK FOR DUAL COLUMN PAGE

This application is a continuation-in-part application of U.S. application Ser. No. 08/742,884 filed Nov. 1, 1996 now U.S. Pat. No. 5,803,012.

BACKGROUND AND SUMMARY OF THE INVENTION

The present invention relates to a bookmark that a reader uses to mark a particular location in a book. More particularly, the present invention relates to a bookmark that marks a particular page, line, and column in the book where the reader wishes to resume reading.

Readers use books as a source of entertainment and education and often find it necessary to stop reading a book before they have finished reading the book. It is convenient to mark a location in the book where the reader stops reading to reduce the time needed to find the location in the book when the reader wishes to resume reading later.

According to the present invention, a bookmark is provided for use in a book having a height and a plurality of pages. Each of the plurality of pages has a plurality of lines and columns. When the book is open, a right-hand page and a left-hand page face a reader of the book. The bookmark includes a flat elongated member, first and second page indicators, a marker, and a column indicator. The flat elongated member includes a first end, a second end spaced apart from the first end, a middle region situated between the first and second ends, a first side, and a second side facing away from the first side. The first and second page indicators include indicia positioned on the flat elongated member. The marker marks a selected line of the book. The marker is fixed relative to and spaced apart from the first and second page indicators. The marker is situated in the middle region of the flat elongated member. The column indicator is positioned on the flat elongated member.

Additional features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 2 is a perspective view showing the bookmark placed in the book to mark a specific line of text on the inner column of the right-hand page;

FIG. 3 is a perspective view showing the bookmark placed in the book to mark a specific line of text on the outer column of the fight-hand page;

FIG. 4 is a perspective view showing the bookmark placed in the book to mark a specific line of text on the inner column of the left-hand page;

FIG. 5 is a perspective view showing the bookmark placed in the book to mark a specific line of text on the outer column of the left-hand page;

DETAILED DESCRIPTION OF THE DRAWINGS

Figure 1:
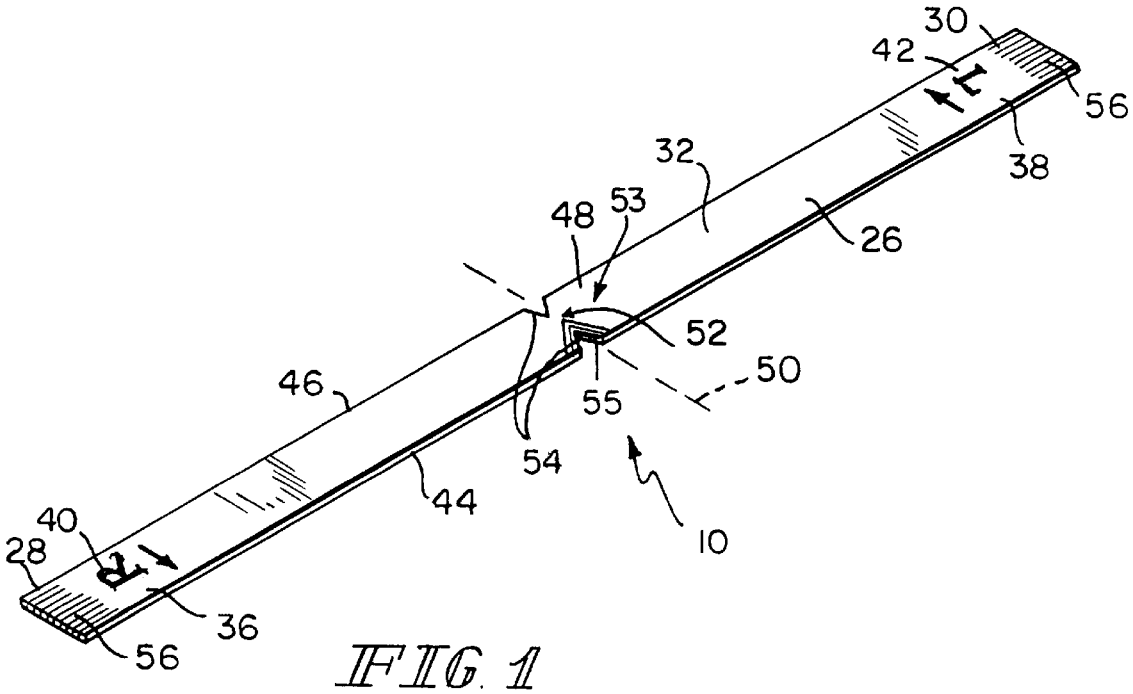
FIG. 1 is a perspective view of a dual column bookmark according to the present invention showing the bookmark including a flat elongated member, a page indicator that indicates a specific page in the book, a column indicator that indicates a specific column on the page, and a line marker that marks a particular line of text, the page indicator being "R" and "L" indicia and arrow indicia, the line marker being a pair of notches formed in the flat elongated member, and the column indicator being column indicia around one of the notches.

A bookmark 10 in accordance with the present invention is shown in FIG. 1. The bookmark 10 includes a flat elongated member 26 having a first end 28, a second end 30 spaced apart from the first end 28, a first side 32, and a second side 34 which is facing away from the first side 32 as shown, for example, in FIGS. 1 and 7. The bookmark 10 further includes a first page indicator 36 on the first end 28 and second page indicator 38 on the second end 30. As shown in FIG. 1, the first page indicator 36 of bookmark 10 includes an "R→" indicia 40 and the second page indicator 38 of bookmark 10 includes an "L←" indicia 42.

The flat elongated member 26 further includes spaced-apart first and second edges 44, 46 and a middle region 48 located between the first and second ends 28, 30. The middle region 48 includes a center line 50 that intersects the first edge 44 and the second edge 46 equidistant from the first and second ends 28, 30.

The bookmark 10 further includes a line marker 52 and a column indicator 53. The line marker 52 is located along center line 50 and on first and second sides 32, 34. The line marker 52 marks a particular line of text. In the illustrated embodiment, the line marker 52 includes a pair of arrowhead-shaped notches 54 that interrupt and are located on the first and second edges 44, 46 and are appended to the flat elongated member 26. In the illustrated embodiment, the column indicator 53 includes column indicia 55 surrounding a notch 54 of line marker 52. In alternative embodiments, any type of indicia or member may be used as a column indicator. In alternative embodiments, the column indicator may be spaced apart from the line marker.

As FIG. 1 shows, the line marker 52 is fixed relative to the first end 28 and the second end 30 in the middle region 48. Because the line marker 52 is fixed to the middle region 48, the bookmark 10 is a one-piece design.

FIG. 1 shows the first side 32 of bookmark 10. As shown in FIGS. 2–5, the second side 34 of bookmark 10 is identical to first side of bookmark 10.

FIGS. 2–5 show the bookmark 10 lying within an open book 12. The book 12 includes a top end 14, a bottom end 16, a spine 15, a side edge 17 extending between the top and bottom ends 14, 16, and a plurality of pages 18. When book 12 is open, a left-hand page 20 and a right-hand page 22 face a reader of the book 12. Each of the left-hand page 20 and right-hand page 22 include a particular line 24 of text 24 and inner and outer columns 19, 21.

A reader indicates the last page read by placing an appropriate end 28, 30 of the bookmark 10 at the top end 14 of the open book 12. The reader selects the appropriate end 28, 30 of the bookmark 10 by noting whether the reader stopped reading on the left-hand page 20 or the right-hand page 22. The reader selects the end 28 with the "R→" indicia 40 when the reader should resume reading on the right-hand page 22 or the end 30 with the "L←" indicia 42 when the reader should resume reading on the left-hand page 20. The reader then places the selected end 28, 30 at the top end 14 of the book 12.

Figure 2:
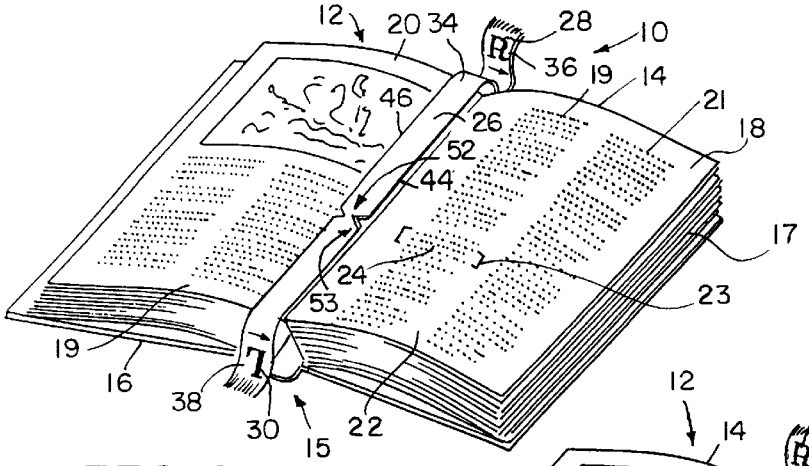
FIGS. 2–5 are perspective views of the dual column bookmark of FIG. 1 lying in an open book having right and left-hand pages and inner and outer columns on each page.

When the reader resumes reading, she or he references the indicia 40, 42 on the end 28, 30 of the bookmark 10 near the top end 14 of the book 12. This indicia 40, 42 notifies the reader as to which page 20, 22 to resume reading. As shown in FIG. 2, the reader placed the end 28 with the "R→" indicia 40 at the top end 14 of the book 12 when she or he stopped reading the book 12. Therefore, the reader should resume reading on the right-hand page 22 as indicated by the "R→" indicia 40. By referencing the indicia 40, 42 near the top end 14 of the book 12, the reader saved time by not having to scan both pages 20, 22 of the book 12 to determine where to resume reading.

A reader indicates a specific line 24 on which the reader wishes to resume reading by moving the entire bookmark 10 and aligning the line marker 52 with the specific line 24 to be marked. When the reader resumes reading the book 12, the reader scans the first edge 44 and/or the second edge 46 for the line marker 52. Once the line marker 52 is located, the reader resumes reading at the marked line 24.

A reader indicates a specific column 19, 21 on which the reader wishes to resume reading by placing column indicator 53 within book 12 so that column indicator 53 faces toward spine 15 of the book 12 or toward the side edge 17 of the book 12. Column indicator 53 may be placed facing toward spine 15 or side edge 17 by placing one of first and second sides 32, 34 against book 12. If the column indicator 53 faces toward the spine 15 of book 12, then the reader knows to resume reading inner column 19 of book 12. If the column indicator 53 faces toward side edge 17 of book 12, then the reader knows to resume reading outer column 21 of book 12.

The bookmark 10 may be oriented within book 12 in many different orientations based on the book text location 23 where a reader is to resume reading. The book text location 25 varies based on the right or left hand page 20, 22, inner or outer column 19, 21, and line 24 of book 12 where the reader is to resume reading.

Figure 3:
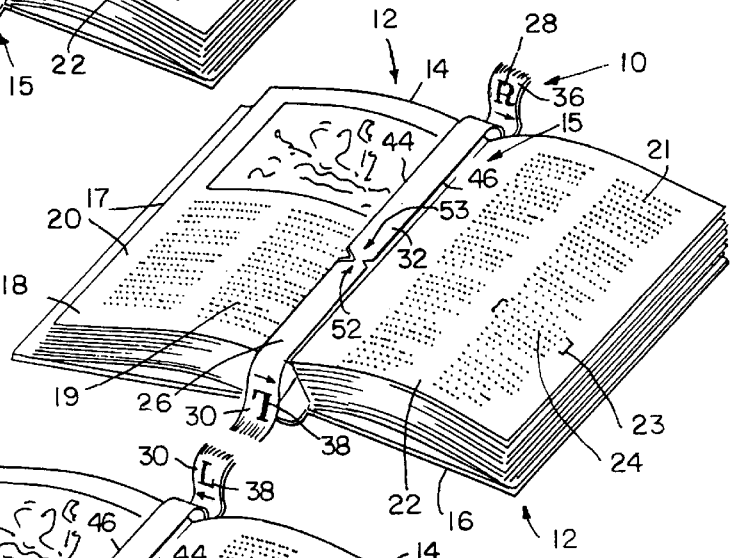
Figure 4:
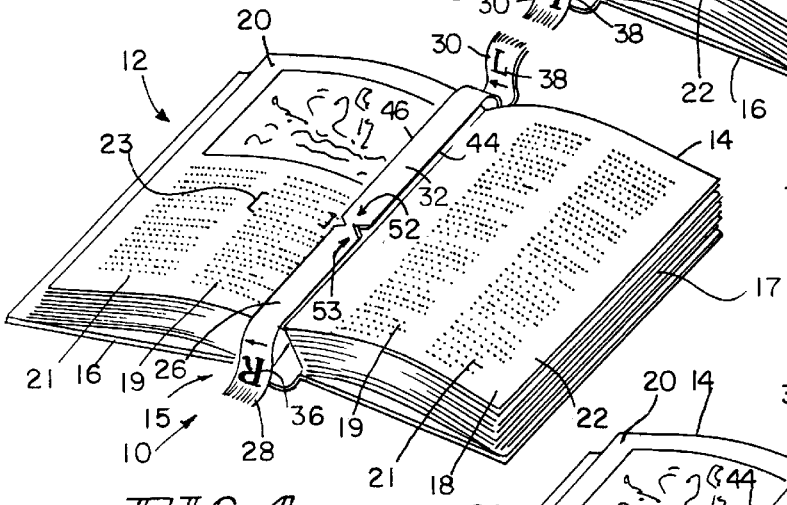
Figure 5:
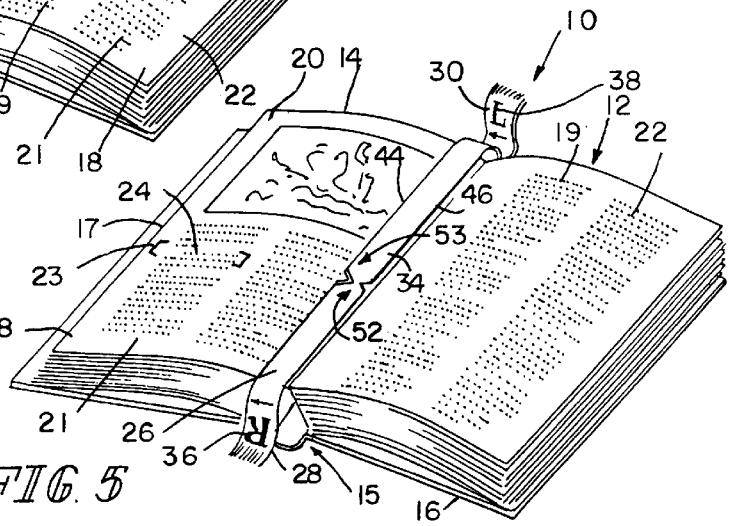

Four representative orientations of bookmark 10 are shown in FIGS. 2–5. In FIG. 2, bookmark 10 is oriented within book 12 to mark a book text location 25 at line 24 of inner column 19 of right-hand page 22. In FIG. 2, bookmark 10 is lying on left-hand page 20 of book 22. In FIG. 3, bookmark 10 is oriented within book 12 to mark a book text location 25 at a line 24 of outer column 21 of right-hand page 22. In FIG. 4, bookmark 10 is oriented within book 12 to mark a book text location 25 at a line 24 of inner column 19 of left-hand page 20. In FIG. 5, bookmark 10 is oriented within book 12 to mark a book text location 25 at a line 24 of outer column 21 of left-hand page 20.

When book 12 is reopened, the bookmark 10 will identify the proper book text location 25 whether bookmark 10 is lying on left-hand page 20 or right-hand page 22 of book 12. The proper book text location 25 is identified because the column indicator 53 of the first and second sides 32, 34 of bookmark 10 are identical and thus each side 32, 34 will properly identify the correct page 20, 22, column 19, 21, and line 24 to resume reading.

Figure 6:
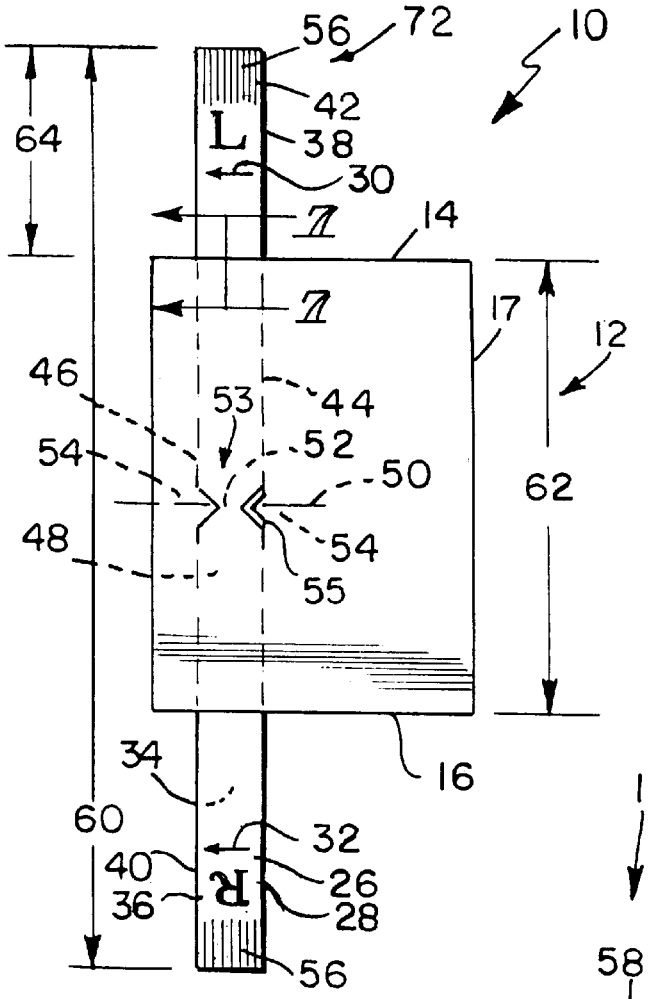
FIG. 6 is a top plan view of the dual column bookmark of FIG. 1 showing the bookmark lying within a closed book, the bookmark having a length, and the book having a book height that is less than the length of the bookmark.

The bookmark 10 shown in FIG. 6 has a length 60 and the book 12 has a height 62 that is less than the bookmark length 60. The greater length 60 of bookmark 10 permits one bookmark 10 to be used with many size books 12.

Furthermore, the bookmark 10 has an excess length 64 that extends beyond the top end 14 of the book 12 as shown in FIG. 6. The excess length 64 of the bookmark 10 allows the reader to roughly approximate the location of the line marker 52 and column indicator 53 within the book 12 by noting the amount of excess length 64 of the bookmark 10. This allows the reader to reduce the time needed to scan along the first edge 44 and/or second edge 46 of bookmark 10 to find the line marker 52 and column indicator 53 because the reader knows in advance of opening the book 12 approximately where the line marker 52 and column indicator 53 are located.

When bookmark 10 is located within a closed book 12, exterior compressive and tensile forces 58 act upon bookmark 10. Such forces 58 can be created by contact with objects, gravity, changes in momentum, jarring or tilting the book, and from other sources. The left-hand page 20 of the book 12 has a left-hand page surface 68 and the right-hand page 22 has a right-hand page surface 70.

In preferred embodiments, the first and second sides 32, 34 of the bookmark 10 have surfaces with high coefficients of friction relative to paper. A surface having a high coefficient of friction creates greater resistive frictional force to act against an applied force 58 than a low coefficient of friction surface creates. When the first and second sides 32, 34 come into contact with the left-hand and right-hand page surfaces 68, 70, respectively, friction is created. This friction helps resist the potential movement of bookmark 10 created by the exterior compressive or tensile forces 58 applied to the bookmark 10.

In preferred embodiments, the bookmark 10 also includes a decorative fringe 56 located on the first and second ends 28, 30 of the flat elongated member 26 as shown, for example, in FIGS. 1–6. The decorative fringe 56 makes the first and second ends 28, 30 more pliable. This increased pliability decreases the likelihood that the forces 58 will push the bookmark 10 away from position marking book text location 25.

As mentioned above, the bookmark 10 is made of a pliable material. A pliable material is both flexible and compliant. Because the bookmark 10 is pliable, exposed ends of the bookmark 10 situated outside of the book 12 may be folded over and placed between two pages in the book 12 so that the book 12 may be easily placed on a shelf without the bookmark 10 interfering with the placement of the book 12 on the shelf.

Pliable members cannot support compressive loads or forces 58. Because bookmark 10 is pliable, common exterior compressive forces 58 applied to the exposed portion 72 of the bookmark 10 will not move the bookmark 10 and cause the marked line 24 to be lost. Furthermore, because the bookmark 10 is made of a pliable material, it is more convenient to store or transport than a more rigid member. A pliable member can be manipulated into many forms. For example, the bookmark 10 can be folded up to fit into a pocket or a purse for easy transportation or storage. The bookmark's pliable nature also resists snapping and breaking that can occur with more rigid elongated bodies.

Figure 7:
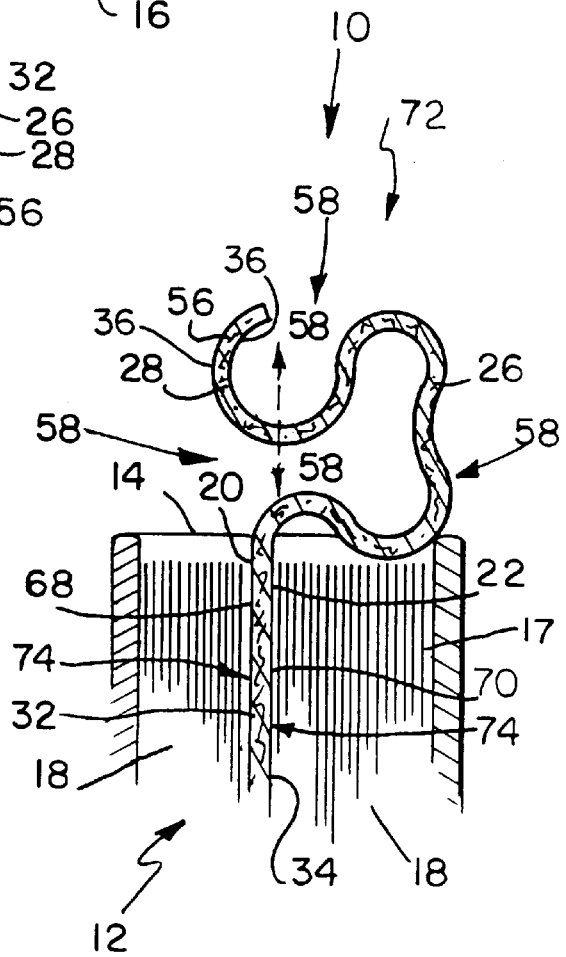
FIG. 7 is a sectional view taken along line 7—7 of FIG. 6 showing the bookmark in contact with the closed book and the pliable nature of the flat elongated member.

Also, the bookmark 10 is made of a compressible material. A compressible material deforms when compressive forces 74 are applied to it. As shown in FIG. 7, when the book 12 is closed with the bookmark 10 within it, internal compressive forces 74 are applied to the bookmark 10 which cause the bookmark 10 to deform. This internal compressive force 74 and the deformation allows the bookmark 10 to rest more securely within the closed book 12.

Suede leather is an example of a material that is pliable, has surfaces with high coefficients of friction, and is compressible. Other suitable materials also exist with these properties that could be used for the bookmark 10.

Figure 8:
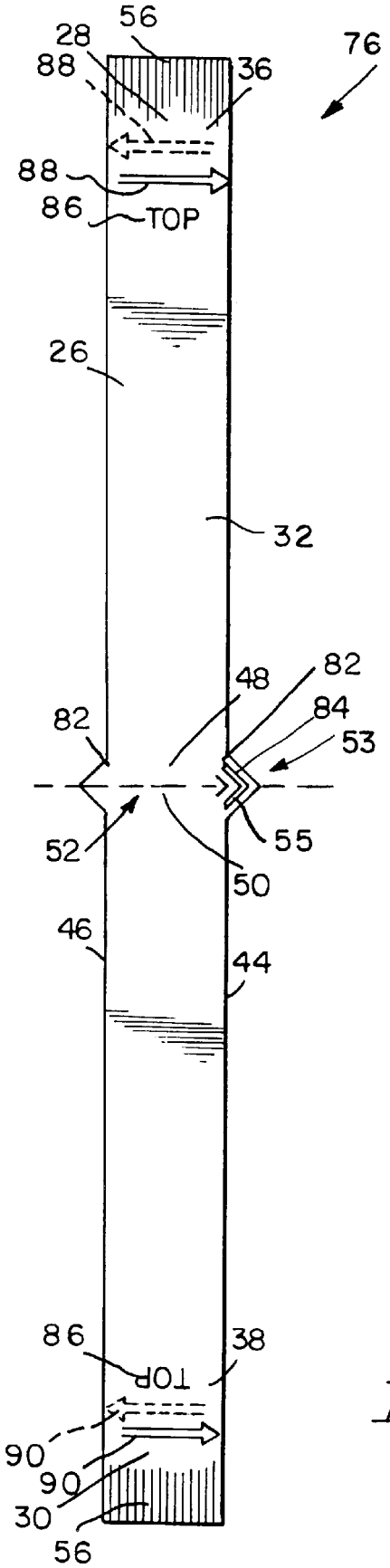
FIG. 8 is a top plan view of another embodiment of the present invention showing a bookmark including a flat elongated member, a page indicator being arrows and "Top" indicia, a pair of line markers being a pair of detents connected to the flat elongated member, and a column indicator including column indicia positioned within one of the detents.

Another bookmark 76 according to the present invention is shown in FIG. 8. This embodiment of the bookmark 76 includes the line marker 52 having detents 82 connected to the flat elongated member 26. The column indicator 53 includes column indicia 84 within a detent 82.

The first and second page indicators 36, 38 include a "TOP" indicia 86 located on the first and second ends 28, 30 of the flat elongated member 26. Furthermore, the first page indicator 36 includes a right-pointing arrow indicia 88 located on the first end 28 and the second page indicator 38 includes a the left-pointing (when FIG. 8 is viewed wrong-side up) arrow indicia 90 located on the second end 30. The first and second page indicators 36, 38 also includes the "TOP" indicia 86 located on the second side 34 at both ends 28, 30, the right-pointing arrow indicia 88 located on the first end 28 of the second side 34, and the left-pointing arrow indicia 90 located on the second end 30 of the second side 34.

In alternative embodiments of the present invention, the arrow indicia may be used without the TOP indicia. In alternative embodiments of the present invention, other indicia may be used to indicate the last page, line, and column read.

The "TOP" indicia 86 notifies the bookmark user to place the corresponding indicator 36, 38 near the top end 14 of the book 12. It also reminds the reader upon resuming reading the book 12 that the corresponding page indicator 36, 38 is located near the top end 14. This helps to eliminate potential confusion for a reader that has forgotten how to use the bookmark over a period of time.

When the right-pointing arrow indicia 88 is located near the top end 14 of the book 12, the reader is notified to continue reading on the right-hand page 22. Conversely, when the left-pointing arrow indicia 90 is located near the top end 14, the reader is notified to continue reading on the left-hand page 20.

Although this invention has been described in detail with reference to certain embodiments, variations and modifications exist within the scope and spirit of the invention as described and as defined in the following claims.

I claim:

1. A bookmark for use in a book including a height and a plurality of pages, each of the plurality of pages have a plurality of lines and columns, and when the book is open a right-hand page and a left-hand page face a reader of the book, the bookmark comprising a flat elongated member having a first end, a second end spaced apart from the first end, a first edge, a second edge spaced apart from the first edge a middle region situated between the first and second ends, a first side, and a second side facing away from the first side, first and second page indicators, each of said first and second page indicators including indicia positioned on the flat elongated member, a marker for marking a selected line, the marker being fixed relative to and spaced apart from the first and second page indicators, and the marker being situated in the middle region of the flat elongated member, and a column indicator positioned on the flat elongated member relative to the first edge to indicate one of the columns as an indicated column.

2. The bookmark of claim 1, further comprising means for maintaining the marker in a fixed position relative to the marked line.

3. The bookmark of claim 2, wherein the maintaining means includes the flat elongated member being made of a pliable material.

4. The bookmark of claim 2, wherein the maintaining means includes the first and second sides of the flat elongated member having a high coefficient of friction relative to paper.

5. The bookmark of claim 2, wherein the maintaining means includes the flat elongated member being made of a compressible material.

6. The bookmark of claim 1, wherein the flat elongated member includes a length that is greater than a height of a book.

7. The bookmark of claim 1, wherein the flat elongated member includes decorative fringe on the first and second ends.

8. The bookmark of claim 1, wherein the first and second sides both include the first and second page indicators, the marker, and the column indicator.

9. The bookmark of claim 1, wherein the first and second page indicators are shaped as arrows.

10. The bookmark of claim 1, wherein the column indicator is adjacent to the marker.

11. The bookmark of claim 10, wherein the line marker includes a notch formed in the flat elongated member and the column indicator is adjacent to the notch.

12. The bookmark of claim 10, wherein the line marker includes a detent connected to the flat elongated member and the column indicator is positioned within the detent.

13. A bookmark for use in a book, the bookmark comprising a flat elongated member having a first end, a second end spaced apart from the first end, a first edge, a second edge spaced apart from the first edge a middle region situated between the first and second ends, a first side, and a second side facing away from the first side, first and second page indicators, the first page indicator being connected to the first end of the flat elongated member, the second page indicator being connected to the second end of the flat elongated member, and the first page indicator being different than the second page indicator, a line marker for marking a selected line of a page of a book as a marked line, the line marker being connected to the middle region of the flat elongated member, and the line marker being fixed relative to the first and second ends, and a column indicator positioned on the flat elongated member relative to the first edge to indicate one of the columns as an indicated column.

14. The bookmark of claim 13, wherein the flat elongated member is pliable.

15. The bookmark of claim 13, wherein the flat elongated member is compressible.

16. The bookmark of claim 13, wherein the first and second sides have a high coefficient of friction relative to paper.

17. The bookmark of claim 13, wherein the first side and second side both include the first and second page indicators, the line marker, and the column indicator.

18. The bookmark of claim 13, wherein the first and second page indicators include indicia shaped as arrows.

19. The bookmark of claim 13, wherein the bookmark further includes a decorative fringe at the first and second end.

20. The bookmark of claim 13, wherein the column indicator is adjacent to the line marker.

21. The bookmark of claim 20, wherein the line marker includes a notch formed in the flat elongated member and the column indicator is adjacent to the notch.

22. The bookmark of claim 20, wherein the line marker includes a detent connected to the flat elongated member and the column indicator is positioned within the detent.

23. A bookmark for use in a book, the bookmark comprising a flat elongated member having a first end, a second end spaced apart from the first end, a middle region situated between the first and second ends, a first side, a second side facing away from the first side, a first edge, and a second edge spaced apart from the first edge, first and second page indicators, the first page indicator being connected to the first end of the flat elongated member and the second page indicator being connected to the second end of the flat elongated member, a line marker connected to the middle region of the flat elongated member, the line marker being fixed relative to the first and second ends, the line marker including a pair of line markers located in the middle region, the pair of line markers being located on the first and second edges, and the pair of line markers being equidistant from the first end, and a column indicator positioned on the flat elongated member relative to the first edge to indicate one of the columns as an indicated column.

24. The bookmark of claim 23, wherein the flat elongated member is pliable.

25. The bookmark of claim 23, wherein the first and second sides have a high coefficient of friction relative to paper.

26. The bookmark of claim 23, wherein the first and second page indicators are spaced apart from the line marker and include indicia positioned on the flat elongated member.

27. The bookmark of claim 23, wherein the flat elongated member is compressible.

28. The bookmark of claim 23, wherein the column indicator is adjacent to the line marker.

29. The bookmark of claim 23, wherein the line marker includes a notch formed in the flat elongated member and the column indicator is adjacent to the notch.

30. The bookmark of claim 23, wherein the line marker includes a detent connected to the flat elongated member and the column indicator is positioned within the detent.

31. The bookmark of claim 23, wherein the first and second sides include the first and second page indicators, the line marker, and the column indicator.

32. A bookmark for use in a book including a height and a plurality of pages, each of the plurality of pages have a plurality of lines, and when the book is open a right-hand page and a left-hand page face a reader of the book, the bookmark comprising a flat elongated member having a first end, a second end spaced apart from the first end, a middle region situated between the first and second ends, a first side, and a second side facing away from the first side, first and second page indicators, the first page indicator being fixed on the first end of the flat elongated member, and the second page indicator being fixed on the second end of the flat elongated member, a pair of markers for marking a selected line on the indicated page as a marked line, the markers being fixed relative to the first and second page indicators, and the pair of markers being situated in the middle region of the flat elongated member, and a column indicator positioned on the flat elongated member.

33. The bookmark of claim 32, wherein the flat elongated member is made of a pliable material.

34. The bookmark of claim 32, wherein the flat elongated member includes a length that is greater than a height of a book.

35. The bookmark of claim 32, wherein the flat elongated member is made of a material having a high coefficient of friction in comparison to paper.

36. The bookmark of claim 32, wherein the bookmark further includes a decorative fringe at the first and second ends.

37. The bookmark of claim 32, wherein the first and second sides both include the first and second page indicators, the pair of markers, and the column indicator.

38. The bookmark of claim 32, wherein the first and second page indicators are spaced apart from the pair of markers and include an indicia positioned on the flat elongated member.

39. The bookmark of claim 32, wherein the column indicator is adjacent to the pair of markers.

40. The bookmark of claim 39, wherein the pair of markers include a notch formed in the flat elongated member and the column indicator is adjacent to the notch.

41. The bookmark of claim 39, wherein the pair of markers includes a detent connected to the flat elongated member and the column indicator is positioned within the detent.

42. A bookmark for use in a book including a height and a plurality of pages, each of the plurality of pages have a plurality of lines and columns, and when the book is open a right-hand page and a left-hand page face a reader of the book, the bookmark comprising a flat elongated member having a first end, a second end spaced apart from the first end, a first edge, a second edge spaced apart from the first edge, a middle region situated between the first and second ends, a first side, and a second side facing away from the first side, page indicators indicating one of the right-hand page and the left-hand page as an indicated page, a marker marking an exact line on the indicated page as a marked line, the marker being fixed relative to the indicators, and the marker being situated in the middle region of the flat elongated member, and a column indicator positioned on the flat elongated member relative to the first edge to indicate one of the columns as an indicated column.

43. The bookmark of claim 42, further comprising means for maintaining the marker in a fixed position relative to the marked line.

44. The bookmark of claim 43, wherein the maintaining means includes the flat elongated member being made of a pliable material.

45. The bookmark of claim 43, wherein the maintaining means includes the first and second sides of the flat elongated member having a high coefficient of friction relative to paper.

46. The bookmark of claim 43, wherein the maintaining means includes the flat elongated member being made of a compressible material.

47. The bookmark of claim 42, wherein the flat elongated member includes a length that is greater than a height of a book.

48. The bookmark of claim 42, wherein the column indicator is adjacent to the marker.

49. The bookmark of claim 48, wherein the marker includes a notch formed in the flat elongated member and the column indicator is adjacent to the notch.

50. The bookmark of claim 48, wherein the marker includes a detent connected to the flat elongated member and the column indicator is positioned within the detent.

51. A bookmark for use in a book including a height and a plurality of pages, each of the plurality of pages have a plurality of lines and columns, and when the book is open a right-hand page and a left-hand page face a reader of the book, the bookmark comprising a flat elongated member having a first end, a second end spaced apart from the first end, a first edge, a second edge spaced apart from the first edge, a middle region situated between the first and second ends, a first side, and a second side facing away from the first side, page indicators indicating one of the right-hand page and the left-hand page as an indicated page, a marker marking an exact line of a page of a book as a marked line, the marker being situated in the middle region of the flat elongated member, the flat elongated member being made of a pliable material and the first and second sides of the flat elongated member having a high coefficient of friction relative to paper, and a column indicator positioned on the flat elongated member relative to the first edge to indicate one of the columns as an indicated column.

52. The bookmark of claim 51, wherein at least one of said page indicators indicating one of the right-hand page and the left-hand page of the book as an indicated page is situated on at least one of the first or second ends of the flat elongated member.

53. The bookmark of claim 52, wherein the marker is fixed relative to the indicator on the flat elongated body.

54. The bookmark of claim 51, wherein the flat elongated member is made of a compressible material.

55. The bookmark of claim 51, wherein the flat elongated member includes decorative fringe on the first and second ends.

56. The bookmark of claim 51, wherein the column indicator is adjacent to the marker.

57. The bookmark of claim 56, wherein the marker includes a notch formed in the flat elongated member and the column indicator is adjacent to the notch.

58. The bookmark of claim 56, wherein the marker includes a detent connected to the flat elongated member and the column indicator is positioned within the detent.

59. A bookmark for use in a book, the bookmark comprising a flat elongated member having a first end, a second end spaced apart from the first end, a first edge, a second edge spaced apart from the first edge a middle region situated between the first and second ends, a first side, and a second side facing away from the first side, first and second page indicators, the first page indicator being connected to the first end of the flat elongated member and the second page indicator being connected to the second end of the flat elongated member, a line marker connected to the middle region of the flat elongated member, the line marker being fixed relative to the first and second ends, and a column indicator positioned on the flat elongated member relative to the first edge to indicate one of the columns as an indicated column.

60. The bookmark of claim 59, wherein the flat elongated member is pliable.

61. The bookmark of claim 59, wherein the flat elongated member is compressible.

62. The bookmark of claim 59, wherein the first and second sides have a high coefficient of friction relative to paper.

63. The bookmark of claim 59, wherein the first page indicator is the same as the second page indicator.

64. The bookmark of claim 59, wherein the first side and second side both include the first and second page indicators, the line marker, and the column indicator.

65. The bookmark of claim 59, wherein the first and second page indicators include indicia shaped as arrows.

66. The bookmark of claim 59, wherein the line marker includes a pair of line markers located in the middle region, .the pair of line markers interrupts and is located on the first and second edges respectively, and the pair of line markers is equidistant from the first end.

67. The bookmark of claim 59, wherein the bookmark further includes a decorative fringe at the first and second end.

68. The bookmark of claim 59, wherein the column indicator is adjacent to the line marker.

69. The bookmark of claim 68, wherein the line marker includes a notch formed in the flat elongated member and the column indicator is adjacent to the notch.

70. The bookmark of claim 68, wherein the line marker includes a detent connected to the flat elongated member and the column indicator is positioned within the detent.

* * * * *